US005096376A

United States Patent [19]

Mason et al.

[11] Patent Number: 5,096,376

[45] Date of Patent: Mar. 17, 1992

[54] LOW WINDAGE CORRUGATED SEAL FACING STRIP

[75] Inventors: Harvey W. Mason, Loveland; Chris B. Jiomacas, Cincinnati; David J. Dietz, Loveland, all of Ohio

[73] Assignee: General Electric Company, Cincinnati, Ohio

[21] Appl. No.: 574,712

[22] Filed: Aug. 29, 1990

[51] Int. Cl.[5] ..... F01D 11/02

[52] U.S. Cl. ..... 415/173.5; 415/173.4; 415/174.4; 415/174.5; 277/53; 277/215

[58] Field of Search ..... 415/170.1, 173.1, 173.4, 415/173.5, 174.4, 174.5, 230; 277/53, 96.1, 215

[56] References Cited

U.S. PATENT DOCUMENTS

Re. 30,600 5/1981 Long et al. .
2,963,307 12/1960 Bobo .
3,501,089 3/1970 Alford ..... 277/53
3,589,475 6/1971 Alford ..... 415/230
3,916,054 10/1975 Long et al. .
4,346,904 8/1982 Watkins, Jr. .
4,395,196 7/1983 Plautz .
4,554,789 11/1985 Napoli et al. .
4,618,152 10/1986 Campbell .

FOREIGN PATENT DOCUMENTS 0793886 4/1958 United Kingdom ..... 415/173.4

*Primary Examiner*—Edward K. Look
*Assistant Examiner*—Christopher M. Verdier
*Attorney, Agent, or Firm*—Jerome C. Squillaro

[57] ABSTRACT

An improved seal design is provided for use in a gas turbine engine. A corrugated facing strip, with a reduced corrugation height, is attached to the exposed end faces of a seal land to reduce windage losses at the exposed end faces. The corrugated facing strip simplifies construction of the seal land and provides a low windage loss surface at seal end faces.

20 Claims, 6 Drawing Sheets

LOW WINDAGE CORRUGATED SEAL FACING STRIP

BACKGROUND OF THE INVENTION

1. Field of the Invention

The present invention relates generally to fluid seals for gas turbine engines. In particular, the invention relates to a seal having low windage loss properties. The seal includes a multi-celled seal land with a corrugated strip height H. A corrugated facing strip with a reduced corrugation height h is attached to exposed end faces of the seal land to simplify construction of the seal land and to provide a low windage loss surface at exposed seal land end faces.

2. Description of the Known Art

Gas turbine engines typically include seals to restrict the flow of the gases between rotating and non-rotating components. Control of leakage through such seals is important because excessive gas leakage degrades engine performance. For instance, a compressor discharge pressure seal is used to restrict the flow of compressor discharge air between rotating compressor components and stationary combustor components. Tight seal clearances are critical, because air leaking past the seal is lost to the engine power cycle. Air that passes through the seal is typically used for cooling downstream engine components.

The tight clearances required for such seals are difficult to maintain because of relative motion of the rotating and non-rotating engine components during engine operation. Vibration, aircraft maneuver loads, and differential thermal growth contribute to this relative movement. Labyrinth type seals are commonly used to accommodate the relative movement of the engine components. Labyrinth seals allow rubbing to occur between rotating and non-rotating components without damage to the seal function or the engine components. Such a labyrinth type seal is shown in U.S. Pat. No. 4,554,789 assigned to the assignee of the present invention. A similar sealing arrangement for accommodating clearances between rotating turbine blades and a stationary case is shown in U.S. Pat. No. 2,963,307 assigned to the assignee of the present invention.

Labyrinth seals include circumferential teeth mounted on a first engine component that face an abradable sealing surface, or seal land, mounted on a second engine component that is rotatable with respect to the first engine component. The teeth cut into the abradable seal land during relative motions between the rotating and non-rotating engine components. As a result, relative motion of the engine components can be accommodated without deforming the seal labyrinth teeth or damaging the engine.

The abradable seal land is commonly a honeycomb structure made of corrugated semi-hexagonal strips forming multiple hexagonal cells. Such hexagonal honeycomb structures are shown in U.S. Pat. No. 4,346,904 issued to Watkins, and U.S. Pat. No. 4,395,196 issued to Plautz.

U.S. Pat. No. 3,916,054 to Long et al. and U.S. Reissue Pat. No. Re. 30,600, a reissue of U.S. Pat. No. 4,022,481 to Long et al., describe a compliant structure comprising an assembly of corrugated strips, where the strips are fixed relative to each other on at least one side of the assembly, and describe combinations of corrugation configurations. U.S. Pat. No. 4,618,152 to Campbell discloses a honeycomb seal structure, and a method of fabricating such a structure.

Honeycomb seal lands are used because less heat is generated during rubbing between the rotating and non rotating engine components. The heat generated during a rub is a function of the amount of material the seal teeth rub against. Honeycomb seal lands are less dense than solid seal lands, and therefore generate less heat during engine rubs.

Such corrugated seal lands typically present a rough, irregular surface to the seal air flow at the seal land sides, or end faces, due to the corrugated strips that are exposed to the seal air flow at the seal land end faces. Because there is aerodynamic drag on the air passing through the seal between the rotating and non-rotating components, there is heating of the air as it passes through the seal. Cooling air passing through the seal is heated by friction induced work done on the cooling air as the air passes over surfaces on the seal, such as the corrugated strips at the seal land end faces. The amount of heating of the air is dependent on the exposed surface area and on the surface roughness. Surface areas and roughness of both the rotating and non-rotating components are important in this respect. Therefore, if the surface roughness can be reduced on part of the exposed surface area of either rotating or non-rotating seal component, the heating of the air passing through the seal can be reduced. Heating of cooling air by friction induced work is also commonly known as windage loss, and is detrimental to engine performance.

Gas turbine engine efficiency is increased by raising turbine operating temperatures. However, as operating temperatures are increased, the thermal limits of certain engine components may be exceeded. Cooling air is required to maintain the temperatures of these components within acceptable limits. Windage losses increase the temperature of the cooling air and reduce the cooling capability of the cooling air. U.S. Pat. No. 4,554,789 listed above addresses heating of cooling air by friction induced work at the labyrinth seals, but does not address heating of the cooling air caused by seal land corrugations.

Prior designs have attempted to reduce windage losses at the seal land end faces by attaching flat strip segments to the seal land sides, or end faces, thereby covering the exposed corrugated strips. Such flat strips require time consuming and costly manual fitup and rework, since they are not adapted to machine automated seal land production. Further, experience has shown the flat strips tend to buckle or warp, and break away from the seal land during braze operations and during engine operation due to differential thermal growth effects.

SUMMARY OF THE INVENTION

It is therefore an object of the present invention to provide a seal land design with low windage loss characteristics.

It is another object of the present invention to provide a seal land design which is adaptable to machine automated production and does not require manual fitup and rework.

It is another object of the present invention to provide a seal land design with reduced windage loss characteristics which will resist buckling, warping, or distortion during engine operation or manufacture.

The objects of the invention will be more fully understood from the drawings and the following description.

Briefly, the present invention includes a reduced height corrugated facing strip to replace the prior flat strip design. The reduced height corrugated facing strip is attached to the seal land at each exposed seal land end face. The reduced height corrugated facing strip is fixedly attached to the seal land end face, preferably by spot welding the corrugated facing strip at spaced intervals to the seal land corrugated strip at each exposed seal land end face.

The facing strip corrugation height is substantially less than the corrugation height of the seal land corrugated strips in order to present a relatively smooth surface to the seal air flow. The reduced height corrugations provide the facing strip with flexibility, or compliance, which permits bending of the facing strip with the seal land corrugation strips to form a ring or ring segment without buckling or warping of the facing strip. As a result, the facing strip can be manufactured integral with the seal land. The seal land can subsequently be formed to a ring or ring segment shape. Thus, the need for manual fitup of a flat strip to cover exposed corrugations at the seal land end face is eliminated.

The compliance provided by the reduced height corrugations also permits differential thermal growth between the facing strip and seal land support structure. Therefore, the facing strip does not buckle or break away from the seal land during engine operation or manufacture. The only surface irregularity presented to the seal air flow by the corrugate facing strip is a relatively slight waviness due to the reduced height corrugations.

BRIEF DESCRIPTION OF THE DRAWINGS

While the specification includes a series of claims which particularly point out and distinctly claim the subject matter which the applicants consider to be their invention, a more complete understanding of the invention will be gained from the following detailed description which is given in connection with the accompanying drawings, in which:

DETAILED DESCRIPTION OF THE DRAWINGS

Figure 1:
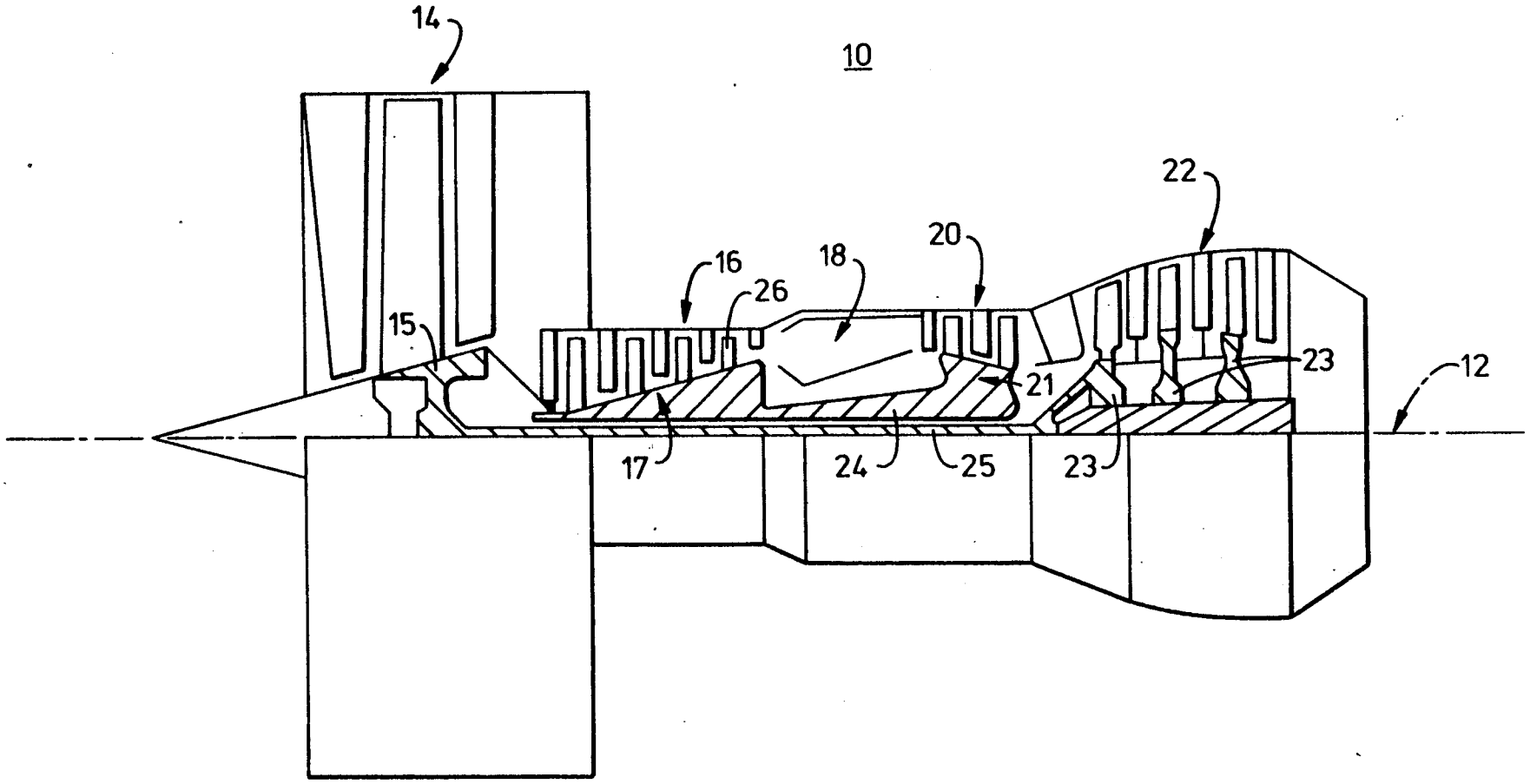
FIG. 1 (PRIOR ART)
FIG. 1 is a simplified schematic of a typical gas turbine engine cross section.

FIG. 1 is a simplified schematic of a typical gas turbine engine 10. Engine 10 includes a fan section 14, a compressor section 16, a combustor section 18, a high pressure turbine section 20, and a low pressure turbine section 22, all generally concentrically arranged about a longitudinal axis 12.

During engine operation air is pulled into fan section 14 and is compressed by bladed rotors 15 and 17 in the fan section 14 and compressor section 16, respectively. Most of the compressed air exiting compressor section 16 flows into combustor section 18 where it is mixed with fuel and burned to produce a high pressure, high temperature gas stream.

The high pressure, high temperature gas stream exiting the combustor section 18 is expanded through the high pressure turbine bladed rotor 21 and low pressure bladed rotors 23. The high pressure turbine bladed rotor 21 drives the compressor bladed rotor 17 through a core shaft 24, and the low pressure turbine bladed rotors 23 drive the fan bladed rotor 15 through a fan shaft 25, which is generally coaxial with shaft 24.

Figure 2:
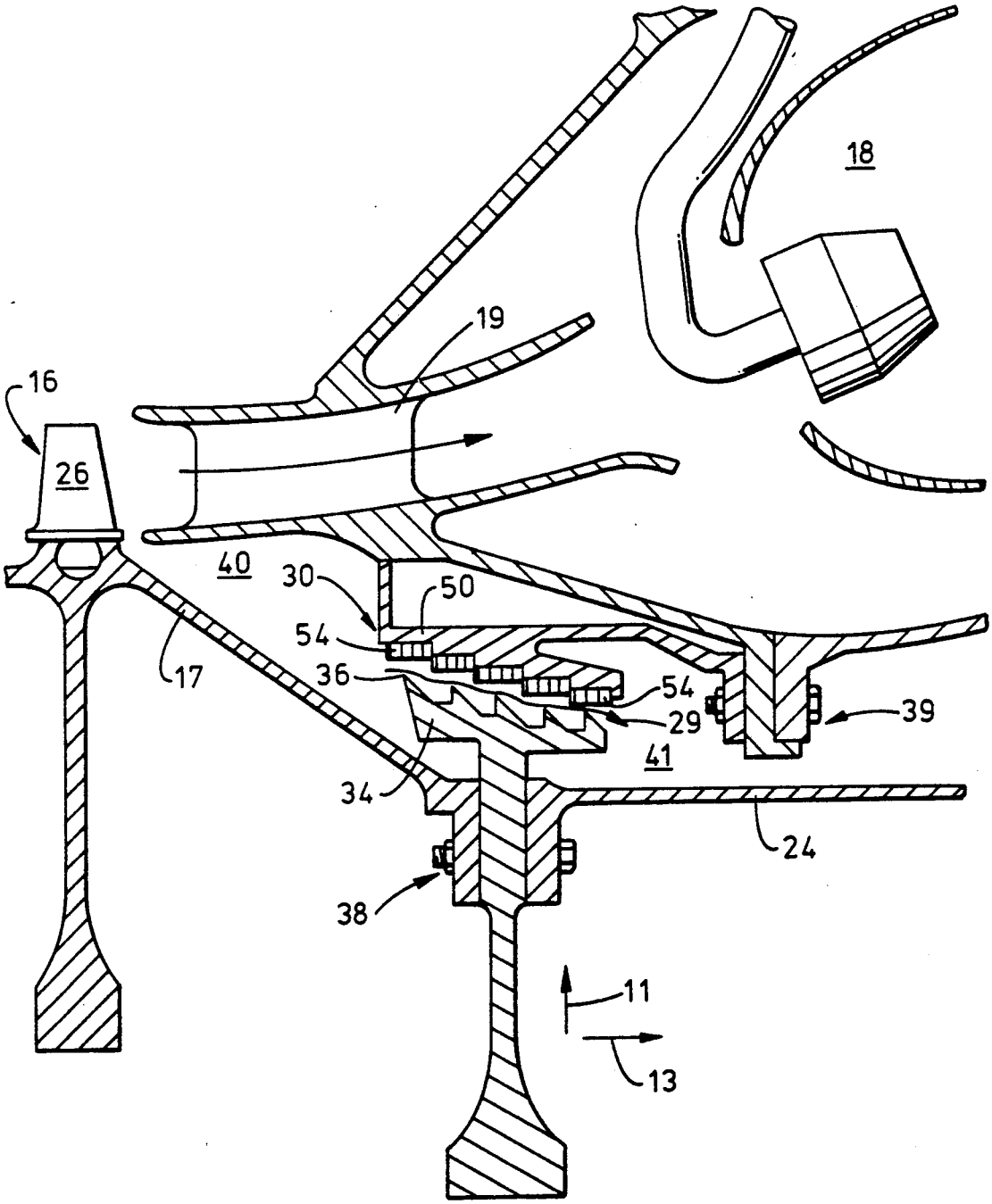
FIG. 2 (PRIOR ART)
FIG. 2 is an enlarged partial cross section of a typical gas turbine engine, such as the one shown in FIG. 1, showing a labyrinth seal structure between the compressor section and the combustor section.

FIG. 2 shows an enlarged cutaway view of the engine structure between the compressor section 16 and the combustor section 18. Compressor discharge air exiting the last row of compressor blades 26 enters a diffuser 19 before entering the combustor section 18. The diffuser 19 does not rotate, and is attached to the stationary combustor section 18. Compressor discharge air can also enter a seal cavity 40, located between the stationary diffuser 19 and the rotating compressor bladed rotor 17.

A portion of the compressor discharge air exiting compressor section 16 is not burned with fuel in the combustor section 18, but is instead used for cooling engine components. For example, arrow 29 in FIG. 2 shows a portion of the compressor discharge air passing through a labyrinth seal structure 30.

Typically, labyrinth seals are used to restrict air flow between rotating and non-rotating engine components throughout the engine. For instance, FIG. 2 shows a labyrinth seal structure 30 restricting flow of compressor discharge air from seal cavity 40, which is a relatively high pressure location, to a relatively low pressure location 41. Air flow control at the seal is critical, since any air that passes through the seal bypasses the combustor and does not contribute to the engine power cycle as a product of combustion. Air that does pass through the seal, such as the air flow represented by arrow 29, can be used to cool downstream engine components.

The labyrinth seal structure 30 includes a labyrinth tooth structure 34 which is generally axisymmetric about longitudinal axis 12. Labyrinth tooth structure 34 is supported from the compressor bladed rotor 17 and the core shaft 24 by suitable means, such as by a plurality of bolt connections 38. The labyrinth tooth structure 34 includes one or more circumferentially and radially extending labyrinth tooth extensions 36. The labyrinth tooth structure shown in FIG. 2 includes five labyrinth tooth extensions.

The labyrinth seal structure 30 also includes a, support structure 50. In the embodiment shown the support structure is a generally axisymmetric backing ring 50 supported from the stationary diffuser structure 19 by suitable means, such as by a plurality of bolt connections 39. The backing ring supports one or more circular seal lands 54.

Figure 3:
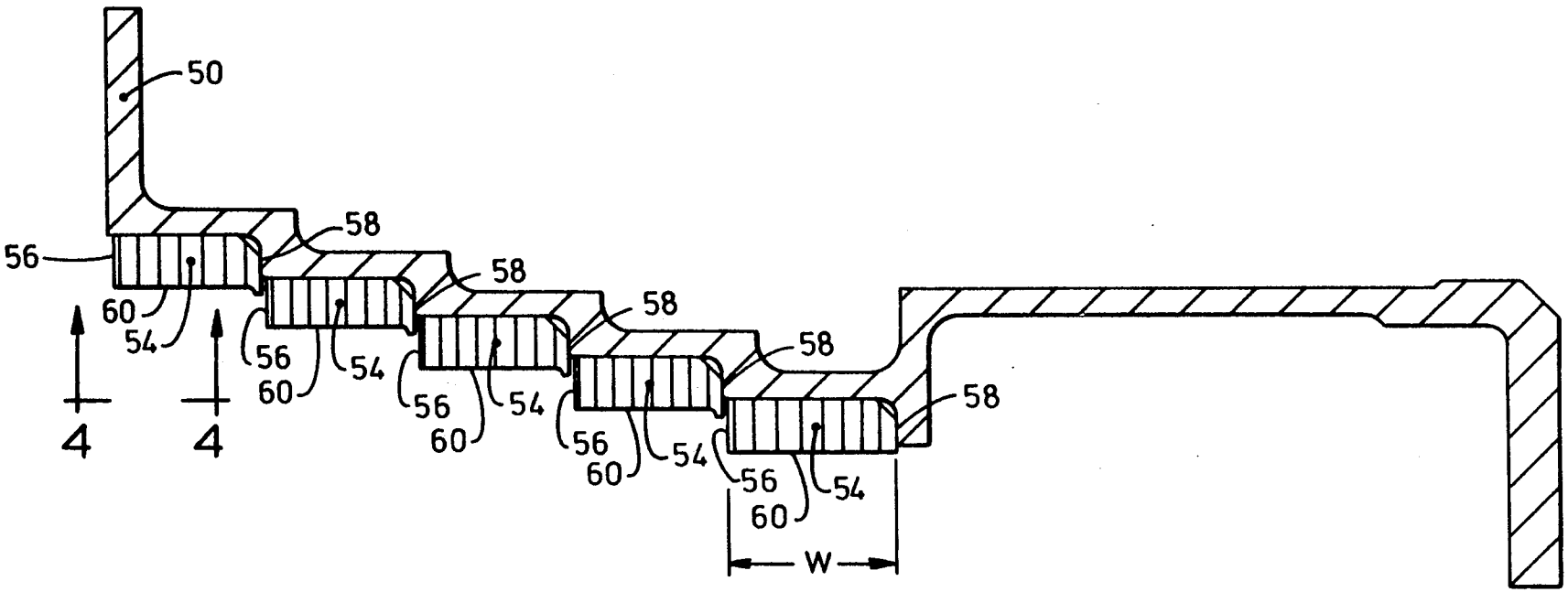
FIG. 3 (PRIOR ART)
FIG. 3 is a cross section of a generally axisymmetric backing ring holding five seal land rings.

FIG. 3 is a more detailed view of a backing ring 50 similar to the one shown in FIG. 2. The backing ring shown in FIG. 3 holds five seal lands, each having a different circumference, though it will be understood by those skilled in the art that any number of seal lands may be attached to a backing ring depending on the particular seal design. Each seal land has a sealing surface 60 facing one or more of the labyrinth tooth extensions 36. The seal surface 60 on each seal land extends from a first end face 56 to a second end face 58. The seal lands 54 are generally attached to the backing ring 50 by brazing.

Figure 4:
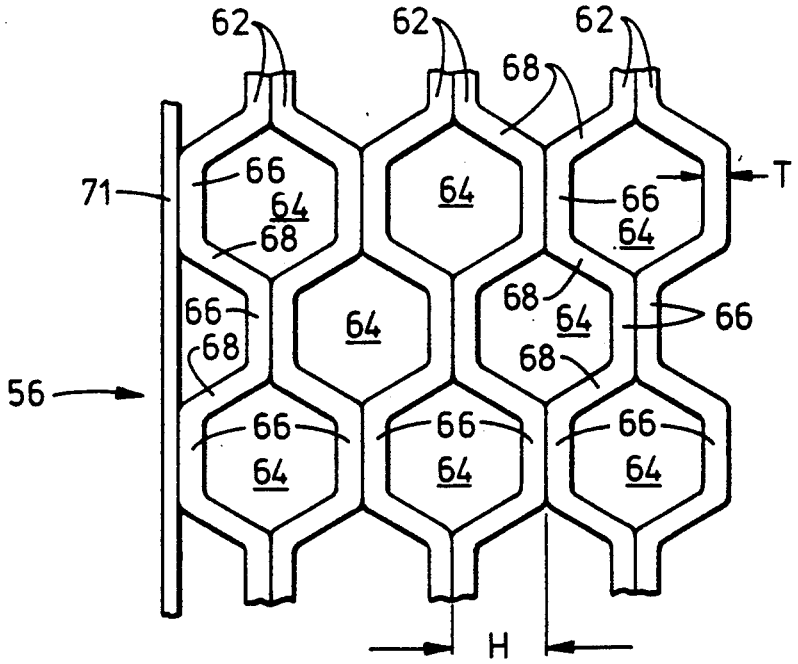
FIG. 4 (PRIOR ART)
FIG. 4 is a known honeycomb seal land structure showing a flat strip at an exposed end face to reduce windage losses, the view taken along lines 4—4 in FIG. 3.

FIG. 4 is a more detailed view along section 4—4 in FIG. 3, and shows a known seal land structure. Each seal land 54 includes a multicelled corrugated strip structure which can be constructed from a plurality of corrugated strips 62 having a corrugation height H and a thickness T. The strips include nodes 66 connected at generally uniformly spaced intervals by side walls 68. The corrugated strips 62 are arranged side-by-side from the seal land first end face 5 to the seal land second end face 58. Adjacent corrugated strips 62 are positioned to form multiple cells 64. Adjacent corrugated strips 62 can be fixedly connected together at every other node, thereby forming multiple cells 64 between the adjacent strips. Cells 64 are open at the sealing surface 60. In some applications the cells 64 may be filled with an abradable insulating material.

The corrugated strips 62 shown in FIG. 4 are semihexagonal and the cells 64 formed between adjacent strips are hexagonal. Seal lands formed from semihexagonal strips are known as honeycomb lands.

During engine operation vibration, maneuver loads, and thermal expansion can result in relative motion and rubbing of the rotating and non-rotating engine structures in the radial direction 11 and axial direction 13 depicted in FIG. 2. The cellular construction of the seal land 54 allows labyrinth tooth extensions 36 to cut into the seal land during such relative motion without permanently damaging the labyrinth tooth extensions 36 or other engine components.

The corrugation height H and thickness T are selected to provide a desired compliance so that the tooth extensions 36 are not damaged during rubbing, and to prevent excess leakage through the seal. Larger cells are generally more compliant for a given thickness T, but are less effective in preventing excess leakage through the seal. Smaller cells, on the other hand, are more effective in preventing excess leakage through the seal, but provide less compliance during rubbing and can result in excessive heat generation. A small value for thickness T is generally desired for low heat generation during rubs. However, the minimum value of T is limited because the braze used to connect seal strips to backing ring 50 can erode and eat through strips having a very thin thickness T.

Generally, it is desirable to minimize the temperature increase of the air 29 passing through the seal because the air will be used for cooling engine components. A seal air temperature increase will decrease the air's cooling capability and limit overall engine performance. Air temperature at the seal can be increased by frictional heat generated by the air flowing over any irregular seal surface.

Generally, more irregular surfaces result in greater frictional heat generation and higher air temperatures. Such air temperature increases generated by air flow over irregular surfaces are generally referred to as windage losses.

In particular, it is known that air flow over the corrugations on the exposed seal land end faces will result in seal air temperature increase due to such frictional heat generation. For example, seal land first end faces 56 in FIG. 3 are exposed to the air flow through the seal, and are a potential source of windage losses. On the other hand, seal land second end faces 58 are relatively unexposed as they face backing ring 50, and therefore are less likely to contribute to windage losses. The degree of exposure of any particular end face will vary from design to design.

A full understanding of the benefits and advantages of the invention to be described will be aided by a description of the known practice of reducing windage losses at seal land end faces.

A honeycomb structure having a desired width W and depth d (FIG. 5) can be produced in continuous lengths using automated equipment and manufacturing methods known in the art. A corrugated strip 62 can be formed by embossing or stamping a flat strip using dies or other means. Adjacent corrugated strips 62 can be spot welded together at every other corrugation node 66, as shown in FIG. 4. Adjacent corrugated strips 62 are preferably spot welded together at two locations across depth d at every other node 66. Corrugation nodes 66 are separated by sidewalls 68 and occur at spaced intervals based on the strip corrugation frequency F. The strip corrugation frequency F can be conveniently defined as the number of nodes 66 per inch of strip length. Creation of the honeycomb structure requires little manual effort.

Figure 5:
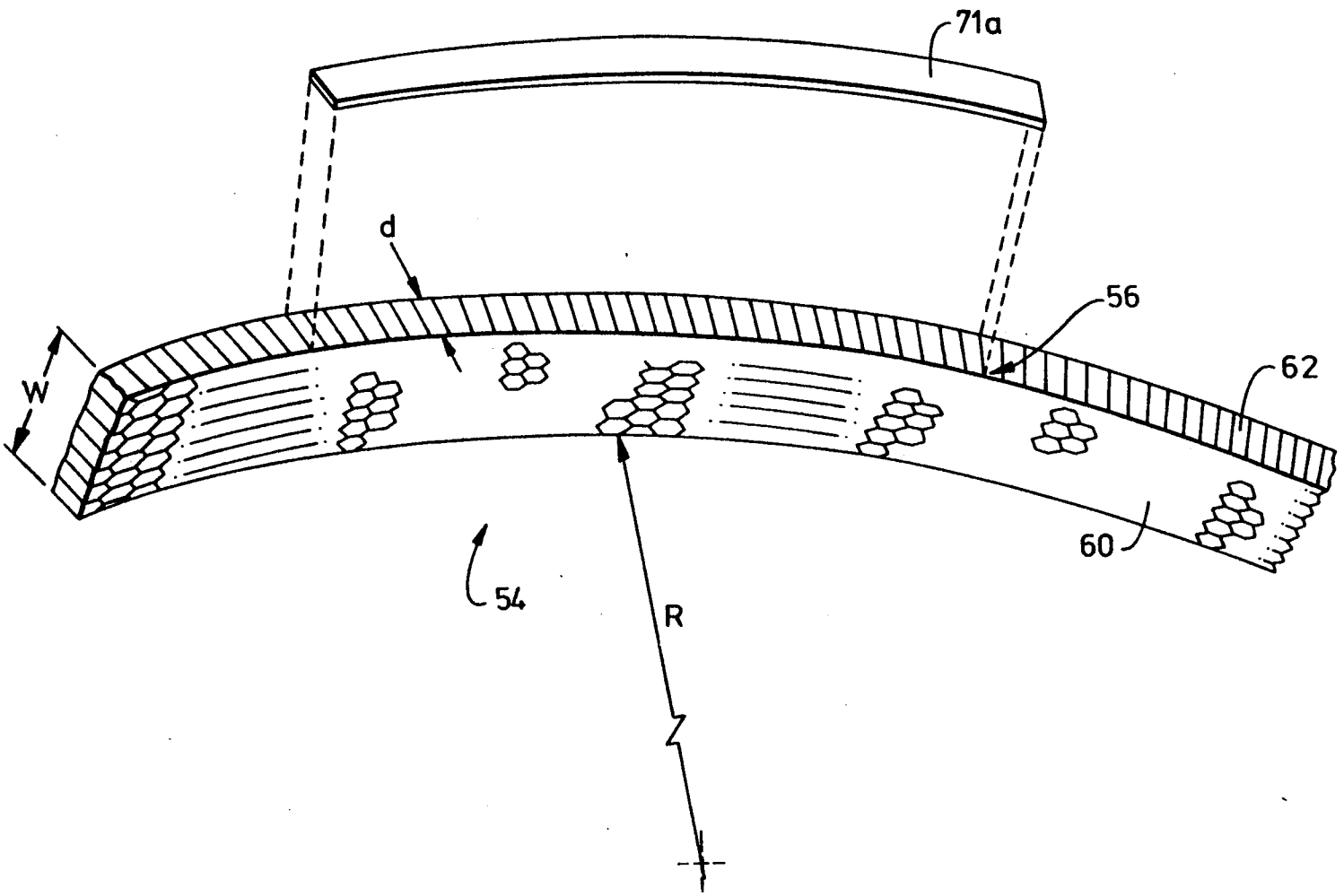
FIG. 5 (PRIOR ART)
FIG. 5 is a schematic of a portion of a seal land ring showing the method of piecing known flat strip arc segments to a seal land end face.

The manufactured honeycomb structure can be cut to a desired length based on a given seal land circumference. For instance, the backing ring 50 in FIG. 3 requires honeycomb structure cut to five different lengths to match the five seal land circumferences. The cut honeycomb structure for each seal land is then bent to form a continuous seal land ring of radius R, and joined at a single seam. A portion of such a seal land ring is shown in FIG. 5. In some seal applications the seal land may be composed of a number of ring segments, rather than a continuous ring.

The seal lands are typically joined to the support structure, or backing ring, by brazing. The seal land corrugated strips 62 may be formed of a commercially available alloy such as Hastelloy-X, while the backing ring may be constructed of a different material with a different coefficient of thermal expansion. The backing ring 50 is typically formed from a commercially available nickel base alloy, such as Inconel 718 or Inconel 907. During brazing or engine operation the seal land corrugated strips 62 and the backing ring 50 will grow thermally relative to one another as the temperature of the components is increased or decreased. The corrugations in corrugated strips 62 provide circumferential compliance, or flexibility, to accommodate this differential thermal growth.

It is also important to realize that the honeycomb structure can be bent into a ring shape without buckling or warping of the individual strips 62 because of the corrugations in strips 62. The corrugations provide compliance for in plane bending which is not present in a flat strip. Bending a flat strip in the plane of the strip will typically result in the strip buckling or deforming because a strip bent in such a manner naturally tends to assume a cylindrical shape.

Figure 6:
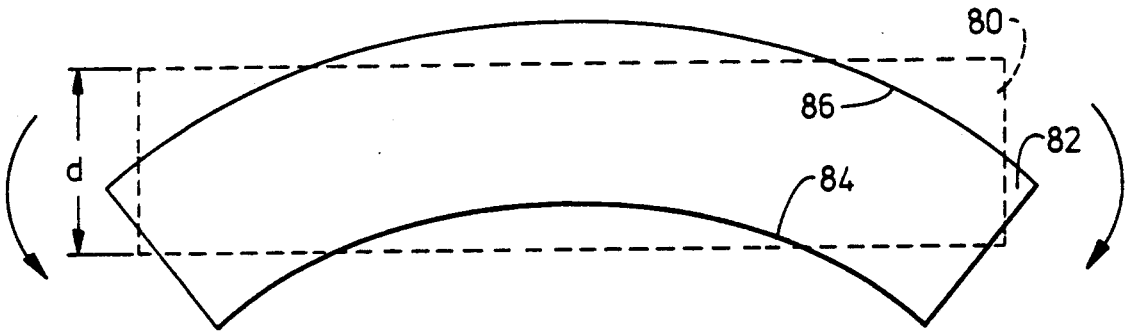
FIG. 6 illustrates the concept of in plane bending of a flat strip.
Figure 7:
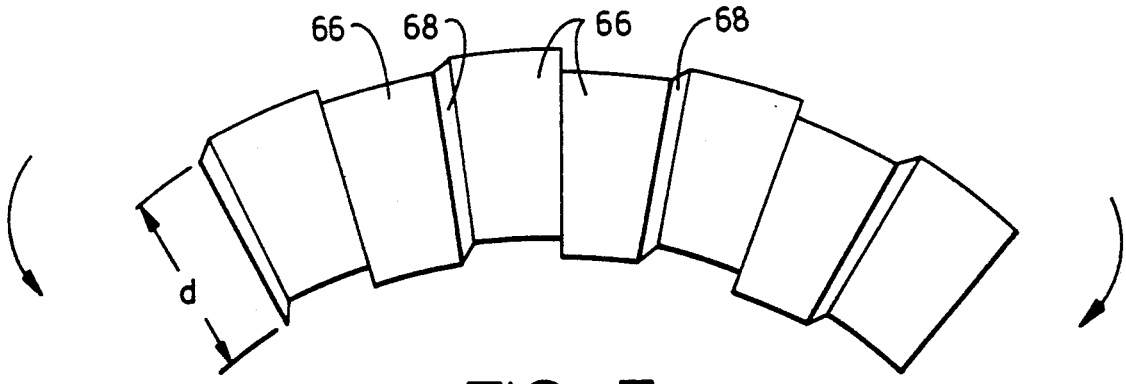
FIG. 7 illustrates in plane bending of a corrugated strip.

The in plane bending compliance of a corrugated strip relative to a flat strip can be better understood by referring to FIGS. 6 and 7. FIG. 6 illustrates theoretical bending of a flat strip 80 (shown in phantom) in the plane of the strip depth d, to form an arc shaped strip 82. Bending the strip causes extension of the edge 86 on the outer radius and compression of edge 84 on the inner radius. As a result, edge 86 is lengthened, and edge 84 is shortened. When the strip depth d is large compared to the strip thickness, the strip tends to buckle or warp out of the plane of the strip (the plane of the strip corresponds to the plane of FIG. 6). The depth d of a seal land strip is typically greater than 10 times the strip thickness. The flat strip warps (warping not shown in FIG. 6) because the flat strip has very little in plane compliance to accommodate extension or compression in the circumferential direction. As a result, in actual practice flat strips cannot be bent as shown in FIG. 6.

In plane bending of the corrugate strip in FIG. 7 does not result in warping or buckling because sidewalls 68 separating nodes 66 provide compliance in the circumferential direction. The strip bends as a bellows or accordion would bend, each corrugation providing circumferential compliance. The corrugations act as springs in series. An increase in the number of corrugations per inch of strip length (in other words, an increase in the strip corrugation frequency F) increases the strip circumferential compliance.

A known practice to reduce windage losses at the seal land end faces employs a flat strip 71 at the seal land end face, as shown in FIG. 4. Theoretically, a flat strip provides the best possible windage loss reduction by presenting the smoothest possible surface to the seal air flow. In practice, however, the use of a flat strip at a seal land end faces results in manufacturing disadvantages.

First, a flat strip cannot be manufactured integral with the seal land shown in FIG. 5 because the flat strip would buckle or warp upon bending the honeycomb structure to form a seal land ring or ring segment. As a result, flat strips for windage loss reduction must be manually fit to the seal land ring in a separate manufacturing step. As shown in FIG. 5, flat strip 71 must be fabricated by cutting or punching flat strip arc segments 71*a* and manually fitting each segment to the seal land ring end face. Six to eight arc segments are normally required per seal land end face, each requiring painstaking manual labor associated with fitup and rework.

Second, the flat strip may not remain flat and smooth during engine operation. The flat strip arc segments 71*a* may buckle and break loose from the seal assembly due to differential thermal growth between the backing ring and the arc segments 71*a*. Experience has shown that buckling is most severe when flat strip arc segments with a high coefficient of thermal expansion are used with a backing ring having a relatively low coefficient of thermal expansion. The arc segments 71*a* may also buckle or warp due to differential thermal growth during the manufacturing braze cycle used to attach the seal land to the backing ring 50. The buckled or warped arc segments 71*a* can result in a wavy and irregular surface with unsatisfactory windage properties.

This problem can be partially offset by using thicker arc segments 71*a* which resist buckling and retain a relatively smooth surface during engine operation. However, thicker arc segments add undesirable weight to the engine. In addition, thicker arc segments are less flexible then thin arc segments, and can result in damage to the labyrinth tooth extensions 36 when the extensions 36 contact the arc segments 71*a* during relative motion and rubbing of the rotating and non-rotating engine structures in the radial direction 11 and axial direction 13. Further, thicker flat arc segments 71*a* can require the same painstaking manual fitup and rework associated with thinner flat arc segments.

Figure 8:
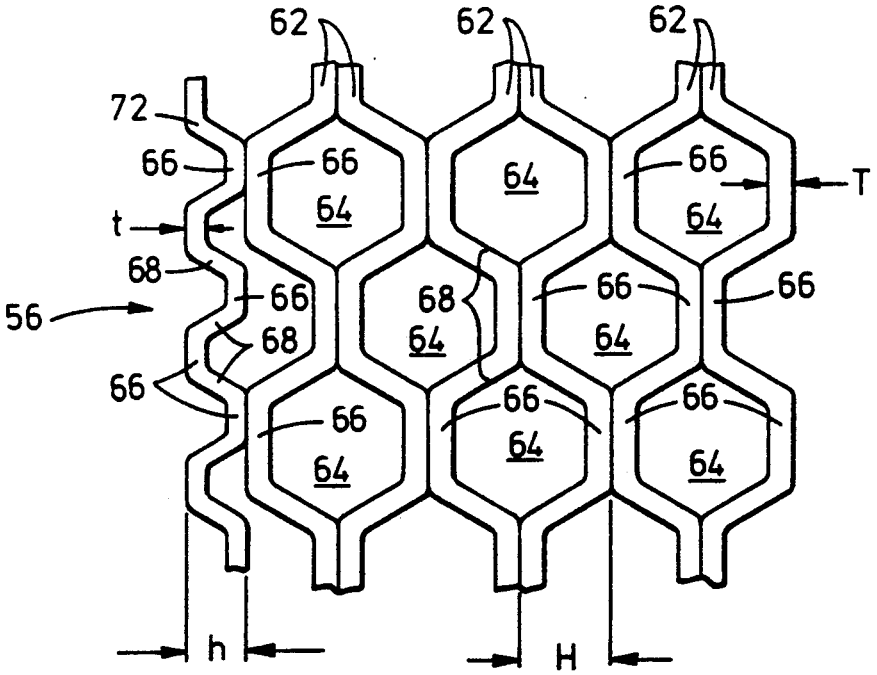
FIG. 8 is a honeycomb seal land structure of the preferred embodiment showing the proposed reduced height corrugated facing strip at an exposed seal land end face, in a view similar to-that of FIG. 4.

The invention disclosed in this application provides for a reduced windage seal by providing a corrugated facing strip 72 attached to an exposed end face of a seal land, as shown in FIG. 8. The corrugated facing strip 72 has a reduced corrugation height h which is less than corrugation height H. The corrugated facing strip 72 presents a smoother, less irregular surface to the seal air flow than is presented by the corrugated strips having height H, thereby reducing windage losses.

A corrugated facing strip 72 in accordance with the present invention eliminates the disadvantages associated with the flat strip 71. Facing strip 72 has corrugation nodes 66 which are separated by sidewalls 68 and occur at spaced intervals based on a facing strip corrugation frequency f. The corrugations make the facing strip 72 compliant so that it can be manufactured integral with the seal land and bent with the other corrugated strips 62 without buckling or warping. A facing strip 72 can be spot welded to a corrugated strip 62 at any exposed seal land end face. The facing strip 72 is preferably spot welded to the corrugated strip at every other node on the corrugated strip. Continuous honeycomb structure, which includes the facing strip 72 on at least one end face, can be manufactured and cut to the required length for a required seal land circumference. As a result, no manual fitup or rework is required, and time and money are saved.

The reduced height corrugations provide circumferential compliance in the facing strip which can also accommodate differential thermal growth between the facing strip 72 on the seal land and the backing ring 50, so that buckling and warping of the facing strip 72 does not occur during engine operation or brazing. As a result, the only surface irregularity of the facing strip is the reduced corrugation height h.

In a preferred embodiment for a labyrinth seal design, the seal land corrugated strips 62 are formed from flat strip stock having a stock thickness T (FIG. 8) between 0.0025 inch and 0.0035 inch, and embossed or stamped to form corrugations having a corrugation height H between 0.0135 and 0.0185 inch. The nominal corrugation height H is about .016 inch. The strip thickness may be locally reduced by about 25 percent where the strip is bent to form the corrugation nodes, with the remainder of the corrugated strip having a generally uniform thickness between 0.0025 inch and 0.0035 inch. The seal land corrugation strip dimensions provide adequate sealing without damage to the labyrinth tooth extensions during rubbing. The corrugated facing strip 72 is formed from flat strip having stock thickness t between 0.0025 inch and 0.0035 inch. The facing strip thickness may be locally reduced by about 25 percent where the strip is bent to form the corrugation nodes, with the remainder of the corrugated facing strip having a generally uniform thickness between 0.0025 inch and 0.0035 inch. The facing strip is embossed or stamped to form corrugations having a reduced corrugation height h which is 0.008 inch or less, and preferably between 0.005 inch and 0.006 inch, inclusive. In the preferred embodiment the reduced corrugation height h is no more than about half the nominal corrugation height H. The ratio of the corrugation height h to flat stock thickness t is between 1.4 and 3.2.

In addition, the facing strip 72 has a corrugation frequency f which is about twice that of corrugation frequency F of the corrugated strips 62. The circumferential compliance of a corrugated strip can be increased by increasing the corrugation height or the corrugation frequency. The increased corrugation frequency f of the facing strip 72 relative to the corrugated strips 62 provides the facing strip 72 with similar circumferential compliance relative to the corrugated strips 62. The corrugation frequency f is preferably a multiple of corrugation frequency F, so that every other node of a corrugated strip 62 on an exposed seal land end face can be spot welded to a node of a facing strip 72.

The invention is equally applicable to other seals with other cell dimensions. In other applications it may be advantageous to use a different honeycomb hexagonal cell dimension. Common honeycomb seal dimensions include 1/64 inch, 1/32 inch, and 1/16 inch honeycomb seal, where the listed seal dimensions are the width across the honeycomb hexagonal cells, or about twice the corrugation height of the semihexagonal corrugated strips forming the seal land. The cell dimension of the honeycomb seal described above in the preferred embodiment for the labyrinth seal is 1/32 inch honeycomb, or about twice the nominal corrugation height H of the corrugated strips 62.

A seal land designed to perform as a turbine blade rub strip may require a 1/16 inch honeycomb cell size, formed from corrugated strips having a corrugation height of about 1/32 inch. According to the teachings of the present invention, a corrugated facing strip having a corrugation height h less than 1/32 inch, and preferably no more than about 1/64 inch (half the corrugation height of the corrugated strips), could be used to provide a low windage surface at exposed end faces of the rub strip.

While the facing strip with the reduced corrugation height in the preferred embodiment is less effective in reducing windage loss than a theoretically flat surface, actual practice has shown that the preferred embodiment facing strip eliminates buckling which can occur in a flat strip design, and provides low windage loss properties. In addition, the invention permits a seal designer to select the height H of the corrugated strips 62 to obtain a cell size which provides the best combination of compliance and sealing for a given seal application, without regard to surface roughness at the seal land end faces. While specific embodiments of the present invention have been described, it will be apparent to those skilled in the art that various modifications can be made without departing from the scope of the invention as recited in the appended claims. For instance, the invention has been described in relation to a compressor discharge labyrinth seal, but is equally applicable to labyrinth seals in other engine locations where windage losses are a concern, such as at high pressure turbine stator outer seals. The invention could also be used with rub strip seals positioned over turbine or compressor rotor blades to reduce windage losses.

Similarly, the invention as described includes the seal land with facing strip connected to a stationary engine component, but other applications might include the seal land and facing strip attached to a rotating engine component. Further, the invention could be applied to virtually any device having a corrugated multi-cell construction where windage losses are a concern.

The present invention has been described in connection with a specific representative example and embodiment. However, it will be understood by those skilled in the art that the invention is capable of other examples and embodiments without departing from the scope of the appended claims.

We claim:

1. In a gas turbine engine having first and second relatively rotatable engine components, a low windage labyrinth sealing structure between the engine components comprising:

(a) a labyrinth tooth structure supported from the first engine component, the labyrinth tooth structure including at least one labyrinth tooth extension;

(b) a backing ring supported from the second engine component;

(c) at least one seal land mounted on the backing ring, each seal land including a sealing surface extending from a first end face to a second end face and facing at least one labyrinth tooth extension, each seal land further including a plurality of corrugated strips having a generally uniform corrugation height H, the corrugated strips arranged side-by-side from the first end face to the second end face to form multiple cells; and (d) a corrugated facing strip attached to a corrugated strip on at least one of the seal land end faces, each corrugated facing strip having a generally uniform corrugation height h which is less than corrugation height H, wherein the corrugated facing strip reduces labyrinth seal windage losses and wherein the facing strip corrugations provide circumferential compliance.

2. The sealing structure as recited in claim 1, wherein each corrugated facing strip has a generally uniform corrugation frequency f, the corrugated strips have a generally uniform corrugation frequency F, and wherein f is greater than F and is a multiple of F.

3. The sealing structure as recited in claim 1, wherein the corrugation height h is no more than about half the nominal corrugation height H.

4. The sealing structure as recited in claim 1, wherein the corrugated strips include nodes separated at generally uniformly spaced apart intervals by sidewalls, adjacent corrugated strips connected together at every other node, and wherein each corrugated facing strip is attached to every other node of a corrugated strip.

5. The sealing structure as recited in claim 1, wherein the facing strip has a generally uniform stock thickness t, and wherein the ratio of the facing strip corrugation height h to the facing strip stock thickness t is between 1.4 and 3.2.

6. The sealing structure as recited in claim 1, wherein each corrugated facing strip is generally semihexagonal with corrugation height h no greater than 0.008 inch, and wherein the corrugated strips are semihexagonal with corrugation height H between 0.0135 inch and 0.0185 inch.

7. The sealing structure as recited in claim 1, wherein each corrugated facing strip is generally semihexagonal with corrugation height h between 0.005 inch and 0.006 inch inclusive, and wherein the corrugated strips are semihexagonal with corrugation height H between 0.0135 inch and 0.0185 inch.

8. The sealing structure as recited in claim 2, wherein the corrugated strips are generally semihexagonal with nodes separated at generally uniformly spaced apart intervals by sidewalls, the corrugated strips having corrugation height H between 0.0135 inch and 0.0185 inch, adjacent corrugated strips connected by spot welds at every other node, and wherein each corrugated facing strip is generally semihexagonal and is attached to every other node of a corrugated strip by spot welds, each facing strip having a generally uniform stock thickness t between 0.0025 inch and 0.0035 inch and a corrugation height h between 0.005 inch and 0.006 inch inclusive.

9. In a gas turbine engine, a reduced windage seal land comprising:

(a) a plurality of corrugated strips having a corrugation height H arranged side-by-side from a first end face to a second end face to form a plurality of cells therebetween;

(b) a corrugated facing strip attached at spaced intervals to at least one of the end faces, the facing strip having a corrugation height h less than the corrugation height H, wherein the corrugated facing strip reduces seal windage losses and the facing strip corrugations provide circumferential compliance.

10. The seal land as recited in claim 9, wherein the corrugated facing strip has a generally uniform corrugation frequency f and the corrugated strips have a generally uniform corrugation frequency F, and wherein f is a multiple of F and is greater than F.

11. The seal land as recited in claim 9, wherein the corrugation height h is no more than about half the nominal corrugation height H.

12. The seal land as recited in claim 9, wherein the facing strip has a generally uniform stock thickness t, and wherein the ratio of the facing strip corrugation height h to the facing strip stock thickness t is between 1.4 and 3.2.

13. The seal land as recited in claim 9, wherein the corrugated facing strip is generally semihexagonal with corrugation height h no greater than 0.008 inch, and wherein the corrugated strips are semihexagonal with corrugation height H between 0.0135 inch and 0.0185 inch.

14. The seal land as recited in claim 9, wherein the corrugated facing strip is generally semihexagonal with corrugation height h between 0.005 inch and 0.006 inch inclusive, and wherein the corrugated strips are semihexagonal with corrugation height H between 0.0135 inch and 0.0185 inch.

15. The seal land as recited in claim 10, wherein the corrugated strips are generally semihexagonal with nodes separated at generally uniformly spaced apart intervals by sidewalls, the corrugated strips having corrugation height H between 0.0135 inch and 0.0185 inch and adjacent corrugated strips connected by spot welds at every other node, and wherein the corrugated facing strip is generally semihexagonal and is attached to every other node of a corrugated strip by spot welds, the facing strip having a generally uniform stock thickness t between 0.0025 inch and 0.0035 inch and a corrugation height h between 0.005 inch and 0.006 inch inclusive.

16. In a gas turbine engine, a reduced windage honeycomb structure comprising:

(a) a multi-celled corrugated strip structure having a generally uniform corrugation height H and extending from a first end face to a second end face; and (b) a facing strip attached at spaced intervals to at least one of the end faces, the facing strip having a generally uniform corrugation height h less than the corrugation height H.

17. The honeycomb structure as recited in claim 16, wherein the corrugation height h is no more than about half the nominal corrugation height H.

18. The honeycomb structure as recited in claim 16, wherein the corrugated strip structure has a generally uniform stock thickness T, and a generally uniform first corrugation frequency F, and Wherein the facing strip has a generally uniform stock thickness t, and a second corrugation frequency f greater than the first corrugation frequency.

19. The honeycomb structure as recited in claim 16, wherein the ratio of H to h is between 1.6 and 3.7.

20. The honeycomb structure as recited in claim 18, wherein H is between 0.0135 inch and 0.0185 inch, h is between 0.005 inch and 0.006 inch inclusive, t is between 0.0025 inch and 0.0035 inch, T is between 0.0025 inch and 0.0035 inch, f is at least twice F, and wherein the facing strip is attached to the end face at spaced intervals by spot welding.

* * * * *